US007920711B2

(12) United States Patent
Takashima et al.

(10) Patent No.: US 7,920,711 B2
(45) Date of Patent: Apr. 5, 2011

(54) AUDIO DEVICE AND METHOD FOR GENERATING SURROUND SOUND HAVING FIRST AND SECOND SURROUND SIGNAL GENERATION UNITS

(75) Inventors: Noriyuki Takashima, Iwaki (JP); Masaichi Akiho, Iwaki (JP); Hareo Hamada, Musashino (JP)

(73) Assignees: Alpine Electronics, Inc., Tokyo (JP); Dimagic Co., Ltd., Tokyo (JP)

( * ) Notice: Subject to any disclaimer, the term of this patent is extended or adjusted under 35 U.S.C. 154(b) by 1333 days.

(21) Appl. No.: 11/382,914

(22) Filed: May 11, 2006

(65) Prior Publication Data

US 2006/0256969 A1 Nov. 16, 2006

(30) Foreign Application Priority Data

May 13, 2005 (JP) ..... 2005-140598

(51) Int. Cl.
*H04R 5/02* (2006.01)

(52) U.S. Cl. ..... 381/307; 379/406.01; 379/406.08

(58) Field of Classification Search ..... 381/58, 381/313, 59, 303, 307, 103, 96, 98, 101, 381/102, 27, 28, 63, 61, 71, 77, 79, 80, 97, 381/1, 300, 335, 119, 86, 17–23, 2, 5, 10, 381/302, 26, 71.11, 71.12, 71.1, 71.4, 71.7, 381/71.14, 83, 85; 379/406.01–406.16
See application file for complete search history.

(56) References Cited

U.S. PATENT DOCUMENTS

| | | | | |
|---|---|---|---|---|
| 5,172,415 | A * | 12/1992 | Fosgate | 381/22 |
| 5,199,075 | A * | 3/1993 | Fosgate | 381/307 |
| 5,233,661 | A * | 8/1993 | Kawamura et al. | 381/61 |
| 2004/0032955 | A1 * | 2/2004 | Hashimoto et al. | 381/18 |
| 2005/0008170 | A1 * | 1/2005 | Pfaffinger et al. | 381/96 |
| 2005/0063553 | A1 * | 3/2005 | Ozawa | 381/92 |

FOREIGN PATENT DOCUMENTS

| | | | |
|---|---|---|---|
| EP | 1507441 | A | 2/2005 |
| JP | 2003-333698 | | 11/2003 |
| JP | 2003-333698 | A | 11/2003 |
| JP | 2003333698 | A * | 11/2003 |
| WO | 02/09474 | A | 1/2002 |

* cited by examiner

*Primary Examiner* — Vivian Chin
*Assistant Examiner* — Leshui Zhang
(74) *Attorney, Agent, or Firm* — Patenttm.us

(57) ABSTRACT

An audio device capable of easily generating two or more sets of surround signals based on 2-channel stereo signals and a method for generating surround sound are provided. The audio device 100 includes: an SL signal generation section 20 and a BL signal generation section 40 as first surround signal generation units for receiving an L signal and an R signal as 2-channel stereo signals, extracting a component of the R signal having high correlation with the L signal, subtracting the component from the L signal, thereby generating a first surround signal; and an SR signal generation section 30 and a BR signal generation section 50 as second surround signal generation units for extracting a component of the L signal having high correlation with the R signal, subtracting the component from the R signal, thereby generating a second surround signal. The level of subtracting a component from the L signal or the R signal for generating the first or second surround signal is differentiated each other between the plural sets.

9 Claims, 4 Drawing Sheets

AUDIO DEVICE AND METHOD FOR GENERATING SURROUND SOUND HAVING FIRST AND SECOND SURROUND SIGNAL GENERATION UNITS

BACKGROUND OF THE INVENTION

1. Field of the Invention

The present invention relates to an audio device for generating two or more sets of surround signals from 2-channel stereo signals, and a method for generating surround sound.

2. Description of the Related Art

Conventionally, an audio device which generates a surround signal from 2-channel stereo signals has been well known (for example, see Japanese Patent Laid-open No. 2003-333698). In this audio device, input stereo signals INL and INR are passed through an adaptive non-correlator to generate surround signals SL and SR. For example, the adaptive non-correlator is realized in the adaptive signal processing using an FIR filter.

Although the above-mentioned audio device can generate a set of surround signals SL and SR based on 2-channel stereo signals, there have been no specific descriptions for generating two or more sets of surround signals. Even if an approach for generating a surround signal using the adaptive non-correlator is repeated, the same surround signal is generated only. Therefore, although two or more sets of surround signals are generated based on 2-channel stereo signals, spatially broad surround sound cannot be generated for the increased number of speakers. Therefore, it would be necessary to expand channels by adding different processing circuits (for example, a matrix decode circuit), thereby complicating the configuration and process.

SUMMARY OF THE INVENTION

The present invention has been developed in light of the above-mentioned problems, and the object of the present invention is to provide an audio device capable of easily generating two or more sets of surround signals based on 2-channel stereo signals and a method for generating surround sound.

The audio device according to the present invention includes: a first surround signal generation unit for receiving an L signal and an R signal as 2-channel stereo signals, extracting a component of the R signal having high correlation with an L signal, subtracting the component from the L signal, thereby generating a first surround signal; and a second surround signal generation unit for extracting a component of the L signal having high correlation with the R signal, subtracting the component from the R signal, thereby generating a second surround signal. The audio device comprises plural sets of the first and second surround signal generating units. Each level of subtracting the component from the L signal or the R signal when the first or second surround signal is generated is differentiated therebetween.

The method for generating surround sound according to the present invention includes: receiving an L signal and an R signal as 2-channel stereo signals, extracting a component of the R signal having high correlation with the L signal, subtracting the component from the L signal, thereby generating a first surround signal; and extracting a component of the L signal having high correlation with the R signal, subtracting the component from the R signal, thereby generating a second surround signal. Plural sets of the first and second surround signals are generated, and each level of subtracting the component from the L signal or the R signal when the first or second surround signal is generated is differentiated therebetween.

When the L signal and the R signal are input, the surround signals can be generated by subtracting from one signal a high correlation component with the other signal, and plural sets of the surround signals having different sound effects for a listener can be easily generated by adjusting the level of subtracting the component having high correlation.

Furthermore, it is desired that the above-mentioned first surround signal generation unit extracts the component of the R signal having high correlation with the L signal by updating a filter coefficient of an adaptive filter using an adaptive algorithm, and the second surround signal generation unit extracts the component of the L signal having high correlation with the R signal by updating a filter coefficient of an adaptive filter using the adaptive algorithm. It is desired that a value of the step size parameter μ for use in updating the filter coefficient using the adaptive algorithm is differentiated in each of the plural sets. Otherwise, it is desired that in generating the above-mentioned first surround signal, the component of the R signal having high correlation with the L signal is extracted by updating a filter coefficient of an adaptive filter using the adaptive algorithm, and in generating the second surround signal, the component of the L signal having high correlation with the R signal is extracted by updating a filter coefficient of an adaptive filter using the adaptive algorithm. It is also desired that the value of the step size parameter μ for use in updating a filter coefficient using the adaptive algorithm is differentiated in each of the plural sets. When a component of one of the L and R signals having high correlation with the other signal is extracted using the adaptive filter, plural sets of surround signals can be easily generated by varying the value of the step size parameter μ for use in updating the filter coefficient using the adaptive algorithm.

It is desired that the above-mentioned first surround signal generation unit includes a delay unit for delaying and outputting the L signal; an addition unit for generating an error signal by subtracting a signal obtained by passing the R signal through an adaptive filter from a signal which has passed the delay unit; and an LMS algorithm processing unit for updating a filter coefficient of an adaptive filter using the LMS algorithm so that the power of the error signal can be minimized, and it is desired that the second surround signal generation unit includes a delay unit for delaying and outputting the R signal; an addition unit for generating an error signal by subtracting a signal obtained by passing the L signal through an adaptive filter from a signal which has passed the delay unit; and an LMS algorithm processing unit for updating a filter coefficient of an adaptive filter using the LMS algorithm so that the power of the error signal can be minimized. Thus, using the adaptive filter, the level of a convergence of updating a filter coefficient when extracting the component of the R signal having high correlation with the L signal, or the component of the L signal having high correlation with the R signal can be varied by adjusting the step size parameter μ, thereby easily generating surround signals having different sound effects from each other.

Additionally, it is desired that the LMS algorithm processing unit included in the above-mentioned first surround signal generation unit updates a filter coefficient by adding a value of a product of the R signal, the error signal and the step size parameter μ to the filter coefficient, and it is desired that the LMS algorithm processing unit included in the second surround signal generation unit updates a filter coefficient by adding a value of a product of the L signal, the error signal and the step size parameter μ to the filter coefficient. Thus, by changing the value of the step size parameter μ, the characteristics of an adaptive filter can be changed, and the sound characteristics can be easily changed in generating a surround signal using an adaptive filter.

In addition, it is desired that a surround speaker for outputting a surround signal output from each of the first and second surround signal generation unit in the plural sets is connected to each unit, and the value of the step size parameter μ is unidirectionally changed according to the order of the sequence of mounting positions of the surround speaker. Thus, when plural sets of surround speakers are provided, the surround sound can be output with a different sound effect corresponding to the arrangement of the surround speakers, and the sound space can be changed by adding the surround speakers.

It is also desired that the surround speakers positioned farther from speakers for outputting each of the L signal and the R signal have larger value of the step size parameter μ corresponding to the above-mentioned surround speakers. Thus, a surround signal can be generated with the arrangement of the surround speakers associated, thereby preventing an uncomfortable surround sound from being generated by unnatural sound effect of the entire sound space.

It is further desired that the first and second surround signals are generated by the above-mentioned first and second surround signal generation units by performing an arithmetic process by the DSP. Thus, only by a little changing the contents of the arithmetic process by the DSP, the surround signal corresponding to the each set of the can be generated, thereby possibly simplifying the process required to generate plural surround signals.

DETAILED DESCRIPTION OF THE PREFERRED EMBODIMENTS

Figure 1:
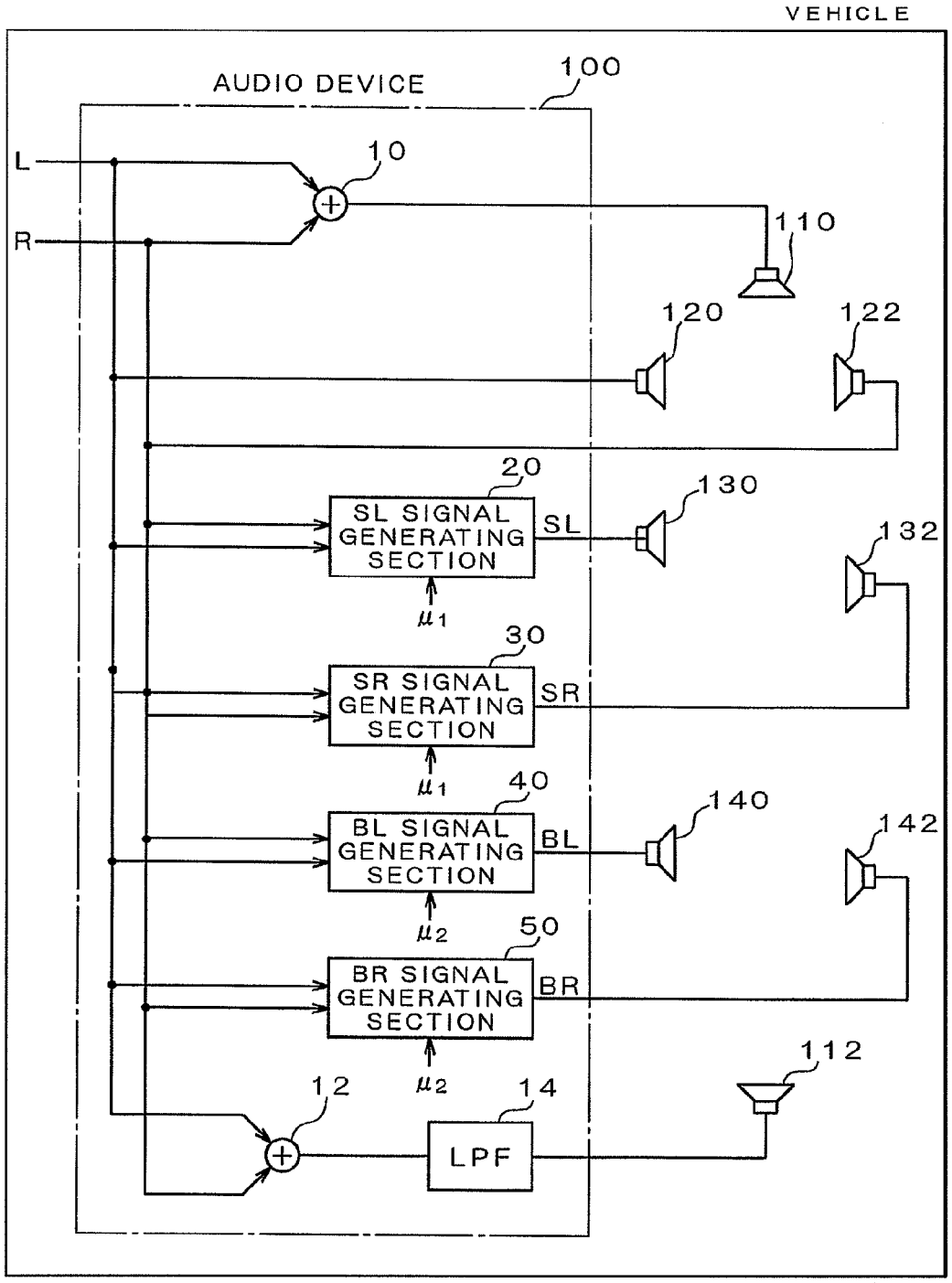
FIG. 1 shows a configuration of an audio device according to an embodiment of the present invention.

The audio device according to an embodiment of the present invention is explained below by referring to the attached drawings. FIG. 1 is a view showing a configuration of an audio device according to an embodiment. An audio device 100 shown in FIG. 1 is loaded into a vehicle, and comprises addition sections 10 and 12, an LPF (low pass filter) 14, an SL signal generation section 20, an SR signal generation section 30, a BL signal generation section 40, and a BR signal generation section 50. Eight (7.1 ch) speakers 110, 112, 120, 122, 130, 132, 140, and 142 are connected to the audio device 100. Surround signals (SL signal, SR signal, BL signal, and BR signal), etc, are generated by the audio device 100 with the arithmetic process by the DSP (digital signal processor).

The addition section 10 adds input stereo signals that is, L signal and R signal. The added signal is output from the speaker 110 as a center speaker mounted in front of a listener. In the same manner as the addition section 10, the other addition section 12 adds input stereo signals. After extracting a low band component from the added signal by means of passing through the LPF 14, the added signal is output from the speaker 112 as a sub-woofer provided behind the listener. According to the present embodiment, the stereo signals are simply added up and output from the speaker 110, but the method for generating a signal output from the speaker 110 is not limited to this method, and other methods can be used.

The SL signal generation section 20 generates a surround L signal (SL signal) based on the input L and R signals, and outputs the signal from the speaker 130 provided to the left of the listener. The SR signal generation section 30 generates a surround R signal (SR signal) based on the input L and R signals, and outputs the signal from the speaker 132 provided to the right of the listener. The BL signal generation section 40 generates a left rear surround L signal (BL signal) based on the input L and R signals, and outputs the signal from the speaker 140 provided to the left and behind the listener. The BR signal generation section 50 generates a right rear surround R signal (BR signal) based on the input L and R signals, and outputs the signal from the speaker 142 provided to the right and behind the listener. The above-mentioned surround L signal and surround R signal are generated by updating the value of the filter coefficient of the adaptive filter using an LMS algorithm. The SL signal generation section 20 and the SR signal generation section 30 correspond to the first and second surround signal generation sections of the first set, and the BL signal generation section 40 and the BR signal generation section 50 correspond to the first and second surround signal generation sections of the second set.

The L signal in the input stereo signal is directly output from the speaker 120 mounted to the left front of the listener. The R signal in the input stereo signal is directly output from the speaker 122 mounted to the right front of the listener.

Figure 2:
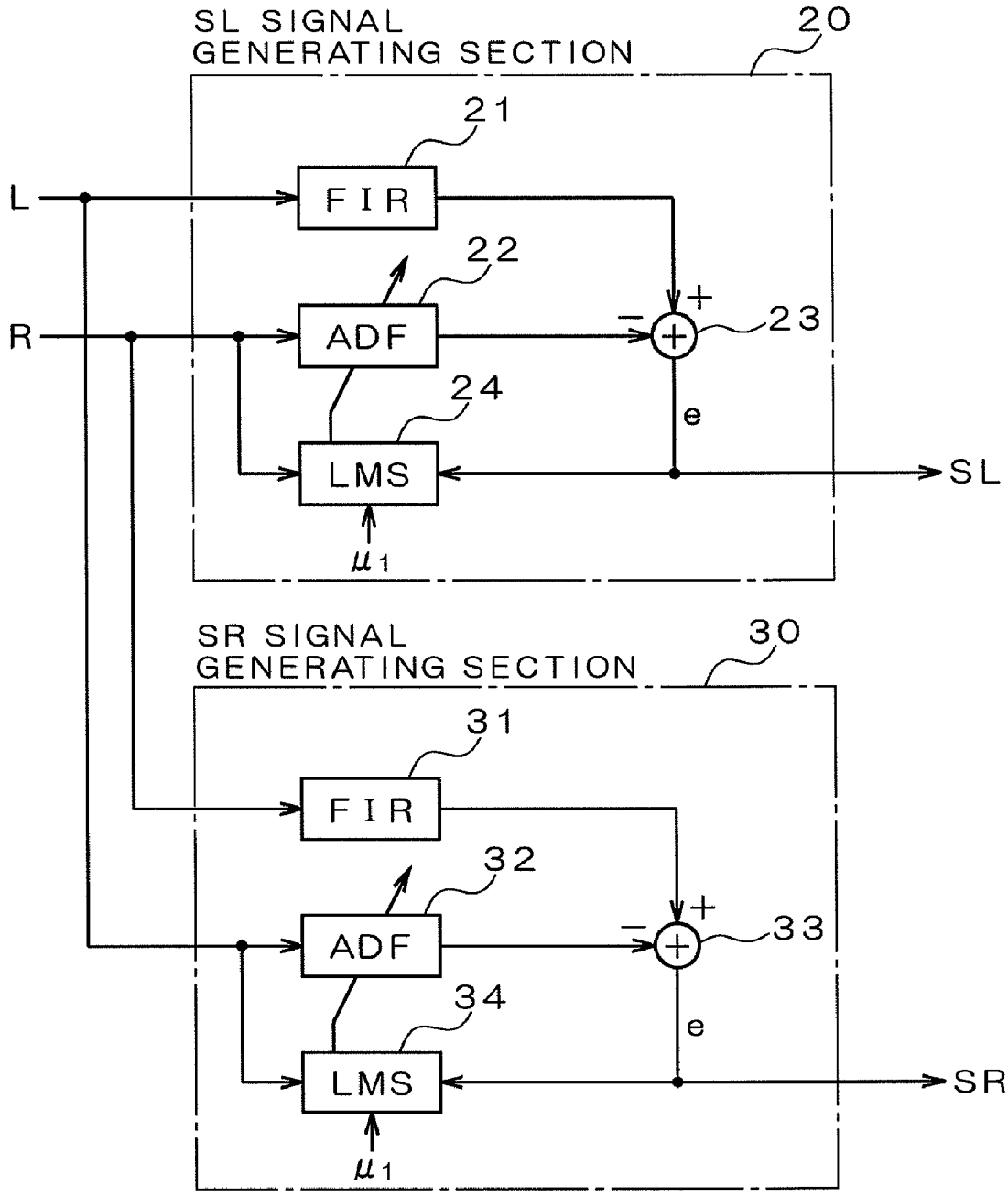
FIG. 2 shows a detailed configuration of an SL signal generation section and an SR signal generation section.

FIG. 2 shows a detailed configuration of the details of the SL signal generation section 20 and the SR signal generation section 30. As shown in FIG. 2, the SL signal generation section 20 comprises an FIR filter 21, an adaptive filter (ADF) 22, an addition section 23, and an LMS algorithm processing section (LMS) 24. The FIR filter 21 is used as a delay circuit (delay unit), and delays an input L signal by the time corresponding to the number of taps (for example, 32 taps), then outputs it. The adaptive filter 22 has the same configuration as the FIR filter, and multiplies the input R signal by a predetermined tap coefficient W, then outputs the result. The addition section 23 is an adding unit, and subtracts a signal which is output from the adaptive filter 22 from the L signal which is output from the FIR filter 21, then outputs an error signal e. The LMS algorithm processing section 24 is an LMS algorithm processing unit, and varies the filter coefficient of the adaptive filter 22 so that the power of the error signal e output from the addition section 23 can be minimized by using the LMS algorithm. The error signal e output from the addition section 23 is output as a surround L signal (SL signal) as is, from the speaker 130.

Figure 3:
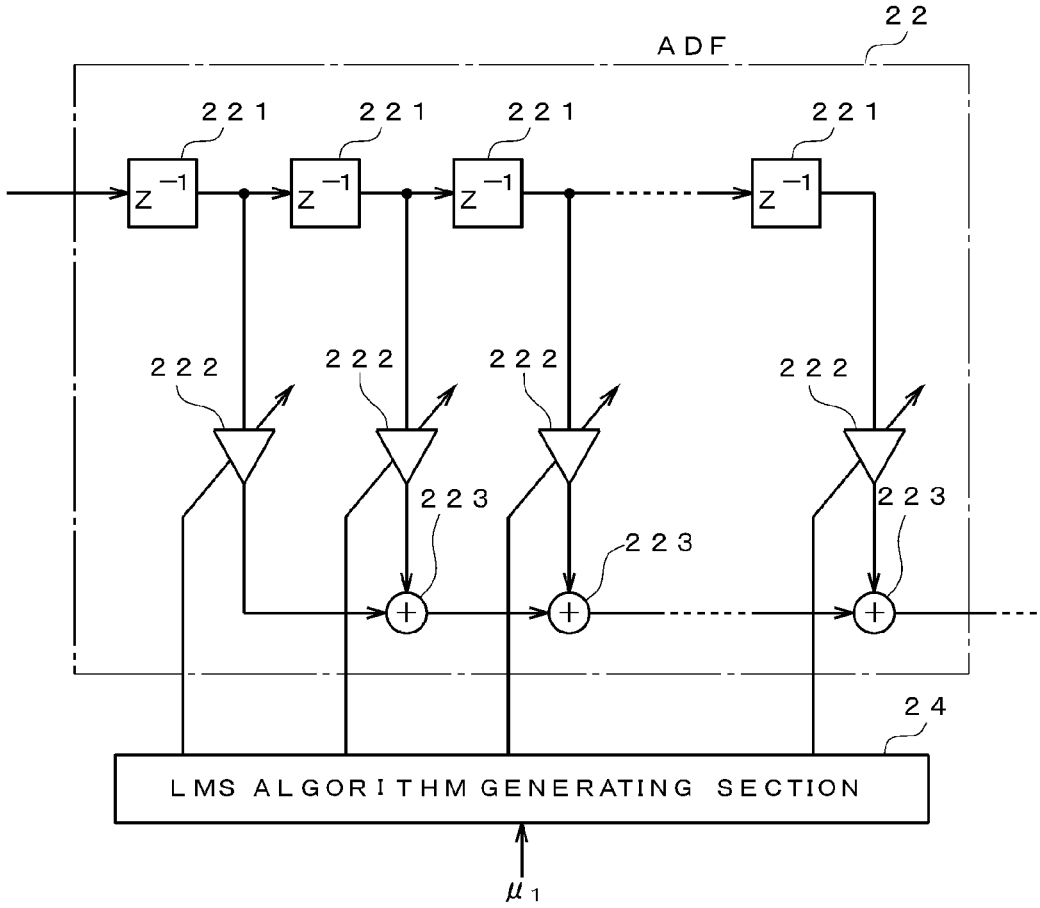
FIG. 3 shows a detailed configuration of an adaptive filter.

FIG. 3 shows the detailed configuration of the adaptive filter 22. As shown in FIG. 3, the adaptive filter 22 comprises plural delay elements 221, plural multiplication sections 222 for multiplying a signal held in the delay element 221 by a variable filter coefficient, and plural addition sections 223 for adding the output of each of the multiplication sections 222. The value of the filter coefficient (multiplier) of each of the plural multiplication sections 222 is updated by the LMS algorithm processing section 24.

The LMS algorithm processing section 24 updates the value of the filter coefficient of the adaptive filter 22 so that the power of the error signal e output from the addition section 23 can be minimized. The adaptive filter 22 updates the value of the filter coefficient so that the component of the input R signal having high correlation with the L signal can be extracted. That is, an R signal and an error signal e output from the addition section 23 are input to the LMS algorithm processing section 24. By processing the R signal and the error signal e with using the LMS algorithm, the LMS algorithm processing section 24 outputs an instruction to update the filter coefficient to each of the multiplication section 222 in the adaptive filter 22, and the value of the filter coefficient superposed on the signal held in each delay element 221 is changed.

Thus, the adaptive filter 22 extracts a component of the R signal having high correlation with the L signal, and the addition section 23 subtracts this component from the L signal. Therefore, the error signal e output from the addition section 23 contains only a component not having high correlation with the R signal in the L signal, and the error signal e is used as a surround L signal.

The LMS algorithm recognizes an instant square error as an amount of evaluation, and the LMS algorithm processing section 24 updates the value of the filter coefficient W by the following equation.

$$W(n+1)=W(n)+2\mu\cdot e(n)\cdot R(n) \quad (1)$$

where μ is a step size parameter. By setting the value large, the convergence of the filter coefficient W is attained faster. On the contrary, by setting the value small, the convergence of the filter coefficient W is attained slower.

The same holds true with the SR signal generation section 30. That is, the SR signal generation section 30 comprises an FIR filter 31, an adaptive filter (ADF) 32, an addition section 33, and an LMS algorithm processing section 34. The FIR filter 31 is used as a delay circuit, and delays an input R signal by the time corresponding to the number of taps (for example, 32 taps), then outputs it. The adaptive filter 32 has the same configuration as the FIR filter, and multiplies the input L signal by a predetermined tap coefficient W, then outputs the result. The addition section 33 subtracts a signal, which is output from the adaptive filter 32 from the R signal, which is output from the FIR filter 31, then outputs an error signal e. The LMS algorithm processing section 34 varies the filter coefficient of the adaptive filter 32 so that the power of the error signal e output from the addition section 33 can be minimized by using the LMS algorithm. The error signal e output from the addition section 33 is output as a surround R signal (SR signal) as is, from the speaker 132.

The LMS algorithm processing section 34 updates the value of a filter coefficient of the adaptive filter 32 so that the power of the error signal e output from the addition section 33 can be minimized. The adaptive filter 32 updates the value of the filter coefficient so that the component of the input L signal having high correlation with the R signal can be extracted. That is, an L signal and an error signal e output from the addition section 33 are input to the LMS algorithm processing section 34. By processing the L signal and the error signal e with using the LMS algorithm, the LMS algorithm processing section 34 outputs an instruction to update the filter coefficient to each of the multiplication section in the adaptive filter 32, and the value of the filter coefficient superposed on the signal held in each delay element is changed.

Thus, the adaptive filter 32 extracts a component of the L signal having high correlation with the R signal, and the addition section 33 subtracts this component from the L signal. Therefore, the error signal e output from the addition section 33 contains only a component not having high correlation with the L signal in the R signal, and the error signal e is used as a surround R signal.

The LMS algorithm recognizes an instant square error as an amount of evaluation, and the LMS algorithm processing section 34 updates the value of the filter coefficient W by the following equation.

$$W(n+1)=W(n)+2\mu\cdot e(n)\cdot L(n) \quad (2)$$

where μ is a step size parameter. By setting the value large, the convergence of the filter coefficient W is attained faster. On the contrary, by setting the value small, the convergence of the filter coefficient W is attained slower.

Figure 4:
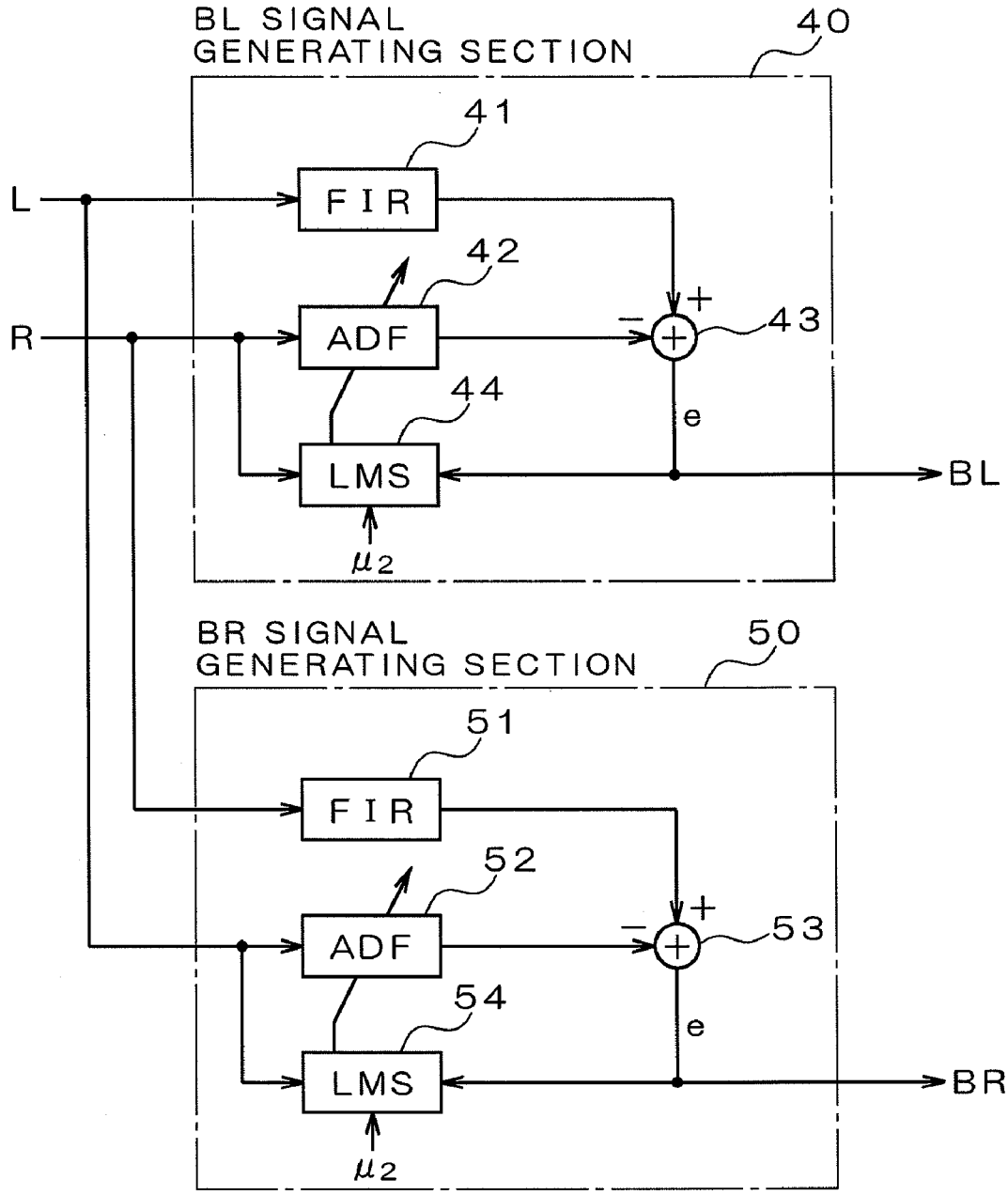
FIG. 4 shows a detailed configuration of a BL signal generation section and a BR signal generation section.

FIG. 4 shows the detailed configuration of the BL signal generation section 40 and the BR signal generation section 50. As shown in FIG. 4, the BL signal generation section 40 comprises an FIR filter 41, an adaptive filter (ADF) 42, an addition section 43, and an LMS algorithm processing section 44. The BR signal generation section 50 comprises an FIR filter 51, an adaptive filter (ADF) 52, an addition section 53, and an LMS algorithm processing section 54. Each operation of the BL signal generation section 40 and the BR signal generation section 50 is basically the same as the operations of the SL signal generation section 20 and the SR signal generation section 30, and the differences are described below.

Assume that the value of the step size parameter μ used to update a filter coefficient in the LMS algorithm processing section 24 in the SL signal generation section 20 or the LMS algorithm processing section 34 in the SR signal generation section 30 is $\mu_1$. Also assume that the value of the step size parameter μ used to update a filter coefficient in the LMS algorithm processing section 44 in the BL signal generation section 40 or the LMS algorithm processing section 54 in the BR signal generation section 50 is $\mu_2$. In the present embodiment, the step size parameter $\mu_1$ used in the SL signal generation section 20 and the SR signal generation section 30 and the step size parameter $\mu_2$ used in the BL signal generation section 40 and the BR signal generation section 50 are set as different values from each other. More preferably, they are set so that the relationship of $\mu_1<\mu_2$ can be satisfied.

As described above, the surround L signal output from the SL signal generation section 20 contains only the component of the L signal not having high correlation with the R signal. When the value of the step size parameter $\mu_1$ is set large, the level of the convergence of the filter coefficient W updated by the LMS algorithm processing section 24 in the SL signal generation section 20, that is, the speed of extracting the component of the R signal having high correlation with the L signal, becomes high. The same holds true with the surround R signal output from the SR signal generation section 30. By varying the step size parameter $\mu_1$, the spread of the sound in case where the surround L signal and the surround R signal are used can be adjusted.

Therefore, by making the value of the step size parameter $\mu_1$ used by the SL signal generation section 20 and the SR signal generation section 30 different from the value of the step size parameter $\mu_2$ used by the BL signal generation section 40 and the BR signal generation section 50, two or more sets of surround signals having different surround effects can be easily generated. Especially, by setting the values to satisfy the relationship of $\mu_1<\mu_2$, a surround sound gradually spreading from front to rear of a listener can be realized, thereby generating more natural output sound.

Thus, when the L signal and the R signal are input, a surround signal can be generated by subtracting from one signal a high correlation component with the other signal. Furthermore, by adjusting the level of subtracting the high correlation component, plural sets of surround signals having different sound effects for a listener can be easily generated.

Especially, in case where a component of one of the L signal and the R signal having high correlation with the other signal is extracted using an adaptive filter, plural sets of surround signals can be easily generated by varying value of the step size parameter μ used when a filter coefficient is updated using the adaptive algorithm. Furthermore, by varying the value of the step size parameter μ, the characteristics of an adaptive filter can be changed, and sound characteristics can be changed when surround signals are generated by utilizing the adaptive filter.

In addition, by unidirectionally changing the value of the step size parameter μ corresponding to the order of the sequence of the arrangement position of surround speakers, surround sounds can be output with different sound effects from each other corresponding to the arrangement of the plural sets of surround speakers when they are provided. By adding surround speakers, the sound space having various sound effects can be realized. Especially, by setting a larger value of the step size parameter μ corresponding to the surround speakers positioned farther from the speakers 120, 122 from which each of the L signal and the R signal are output, a surround signal can be generated as associated with the arrangement of the surround speakers, thereby preventing an unnatural sound characteristics of the entire sound space and uncomfortable sound from being generated. That is, in case of the speakers 120 and 122 for outputting the L signal and the R signal respectively at the front part within the vehicle room, the value of the step size parameter μ corresponding to the surround speakers are set larger as mounted in the rear farther within the vehicle room, thereby generating a surround signal associated with the arrangement of the surround speakers, and preventing an unnatural sound characteristics of the entire sound space and uncomfortable surround sound from being generated.

Furthermore, by generating surround signals (SL signal, SR signal, BL signal, and BR signal) with using the arithmetic process by the DSP, the surround signals corresponding to the each set can be generated only by a little changing the contents of the arithmetic process by the DSP, thereby simplifying the process required in generating plural surround signals.

The present invention is not limited to the above-mentioned embodiments, but there can be variations within the scope of the gist of the present invention. Although the above-mentioned embodiments are shown generating two sets of surround sound (a set of the SL signal and the SR signal, and a set of the BL signal and the BR signal), three or more sets of surround sound can be generated. This can be realized by adding plural sets of the BL signal generation section and the BR signal generation section that have a each different value of the step size parameter μ, respectively.

What is claimed is:

1. An audio device comprising:

a first surround signal generation unit for receiving an L signal and an R signal as 2-channel stereo signals, extracting a component of the R signal having high correlation with the L signal, and subtracting the extracted component of the R signal from the L signal, thereby generating a first surround signal; and a second surround signal generation unit for extracting a component of the L signal having high correlation with the R signal, and subtracting the extracted component of the L signal from the R signal, thereby generating a second surround signal, wherein the first surround signal generation unit extracts the component of the R signal having high correlation with the L signal by updating a filter coefficient of a first adaptive filter using an adaptive algorithm;

the second surround signal generation unit extracts the component of the L signal having high correlation with the R signal by updating a filter coefficient of a second adaptive filter using the adaptive algorithm; and plural sets of the first and second surround signal generation units are provided, and each of the plural sets has a different value of a step size parameter μ for use in updating the associated filter coefficient using the adaptive algorithm, so that each level of subtracting the associated component from the L signal or the R signal when the first and second surround signal is generated is differentiated there between, wherein the plural sets of the first and second surround signal generating units are connected to surround speakers for outputting the first or second surround signals, and wherein the value of the step size parameter μ corresponding to the surround speakers are set larger as farther the surround speakers are positioned from speakers for outputting each of the L signal and the R signal.

2. The audio device according to claim 1, wherein the first surround signal generation unit comprises: a delay unit for delaying the L signal and outputting a delayed L signal; an addition unit for generating an error signal by subtracting a signal obtained by passing the R signal through the first adaptive filter from the delayed L signal which has passed the first surround signal generation unit delay unit; and an LMS algorithm processing unit for updating the filter coefficient of the first adaptive filter using an LMS algorithm so that power of the error signal can be minimized; and the second surround signal generation unit comprises: a delay unit for delaying the R signal and outputting a delayed R signal; an addition unit for generating an error signal by subtracting a signal obtained by passing the L signal through the second adaptive filter from the delayed R signal which has passed the second surround signal generation unit delay unit; and an LMS algorithm processing unit for updating the filter coefficient of the second adaptive filter using the LMS algorithm so that power of the error signal can be minimized.

3. The audio device according to claim 2, wherein:

the LMS algorithm processing unit included in the first surround signal generation unit updates the filter coefficient of the first adaptive filter by adding a value of a product of the R signal, the error signal and the step size parameter μ to the filter coefficient; and the LMS algorithm processing unit included in the second surround signal generation unit updates the filter coefficient of the second adaptive filter by adding a value of a product of the L signal, the error signal and the step size parameter μ to the filter coefficient.

4. The audio device according to claim 1, wherein the speakers for outputting each of the L signal and the R signal are arranged at the front part within a vehicle room; and the value of the step size parameter μ corresponding to the surround speakers are set larger as the surround speakers are positioned in more close to the rear part within the vehicle room.

5. The audio device according to claim 1, wherein the first and second surround signal generation units generate the first and second surround signals by DSP processing.

6. The audio device according to claim 1, wherein the device is loaded into a vehicle.

7. A method for generating surround sound by receiving an L signal and an R signal as 2-channel stereo signals, extracting a component of the R signal having high correlation with the L signal, subtracting the extracted component of the R signal from the L signal, thereby generating a first surround signal, extracting a component of the L signal having high correlation with the R signal, subtracting the extracted component of the L signal from the R signal, thereby generating a second surround signal, wherein the component of the R signal having high correlation with the L signal is extracted in generating the first surround signal by updating a filter coefficient of a first adaptive filter using an adaptive algorithm;

the component of the L signal having high correlation with the R signal is extracted in generating the second surround signal by updating a filter coefficient of a second adaptive filter using the adaptive algorithm; and the first and second surround signals of plural sets are generated, and each of the plural sets has a different value of a step size parameter μ for use in updating the associated filter coefficient using the adaptive algorithm, so that each level of subtracting the associated component from the L signal or the R signal when the first or second surround signal is generated is differentiated there between, wherein the plural sets of the first and second surround signals are output from corresponding surround speakers, and wherein the value of the step size parameter μ corresponding to the surround speakers are set larger as farther the surround speakers are positioned from speakers for outputting each of the L signal and the R signal.

8. The method for generating surround sound according to claim 7, wherein the first surround signal is generated by delaying the L signal by passing through a delay unit, generating an error signal by subtracting a signal obtained by passing the R signal through the adaptive filter from the L signal which has passed the delay unit, and updating the filter coefficient of the first adaptive filter using an LMS algorithm so that power of the error signal can be minimized; and the second surround signal is generated by delaying the R signal by passing through a delay unit, generating an error signal by subtracting a signal obtained by passing the L signal through the adaptive filter from the R signal which has passed the delay unit, and updating the filter coefficient of the second adaptive filter using the LMS algorithm so that power of the error signal can be minimized.

9. The method for generating surround sound according to claim 8, wherein a processing using the LMS algorithm performed to generate the first surround signal is an updating a filter coefficient by adding a value of a product of the R signal, the error signal and the step size parameter μ to the filter coefficient of the first adaptive filter; and a processing using the LMS algorithm performed to generate the second surround signal is an updating a filter coefficient by adding a value of a product of the L signal, the error signal and the step size parameter μ to the filter coefficient of the second adaptive filter.

* * * * *